United States Patent [19]

Nishiwaki et al.

[11] 4,326,232

[45] Apr. 20, 1982

[54] LIGHTNING ARRESTER

[75] Inventors: Susumu Nishiwaki; Toshikazu Satoh, both of Yokohama, Japan

[73] Assignee: Tokyo Shibaura Denki Kabushiki Kaisha, Japan

[21] Appl. No.: 138,675

[22] Filed: Apr. 9, 1980

[30] Foreign Application Priority Data

Apr. 16, 1979 [JP] Japan ..... 54-49426[U]

[51] Int. Cl.[3] ..... H02H 9/04

[52] U.S. Cl. ..... 361/127; 361/126; 361/117; 315/36; 313/231.01

[58] Field of Search ..... 361/127, 126, 128, 130, 361/117; 315/36; 338/20, 21; 313/231.1

[56] References Cited

U.S. PATENT DOCUMENTS 3,838,378 9/1974 Matsuoka et al. ..... 338/21 X 4,035,693 7/1977 Luxa et al. ..... 361/127 X

FOREIGN PATENT DOCUMENTS 49-27845 3/1974 Japan .

54-144946 12/1979 Japan ..... 361/127

*Primary Examiner*—Patrick R. Salce

*Attorney, Agent, or Firm*—Finnegan, Henderson, Farabow, Garrett & Dunner

[57] ABSTRACT

A lightning arrestor comprising at least two stacks of resistor disks juxtaposed within a housing and electrically connected in parallel. The stacks include the same number of disks, at least 35, and preferably 100 or more. Each stack comprises at least two sub-stacks which are aligned end-to-end and electrically connected. Adjacent sub-stacks of parallel stacks are mechanically connected but electrically insulated from each other.

9 Claims, 5 Drawing Figures

VOLTAGE (V)
V1
VA
VB
A
B
IA
IB
1
10
100
1,000
10,000A
CURRENT (I)

UN-EQUALITY
2.5
2.0
1.5
1.0
1
5
10
100
1000
NUMBER OF RESISTOR DISKS STACKED

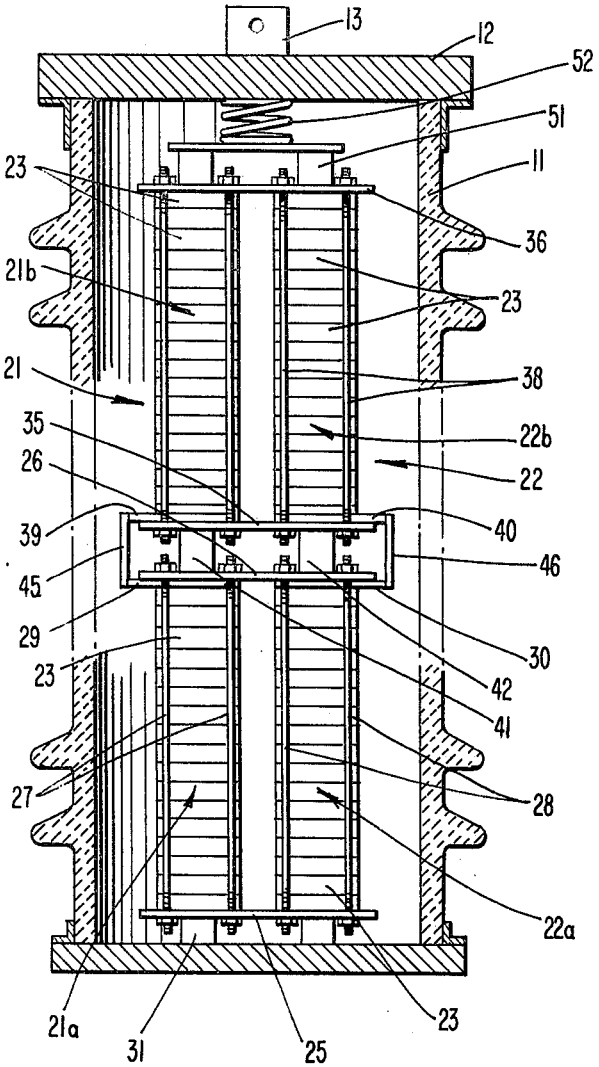
Fig. 3
Fig. 4
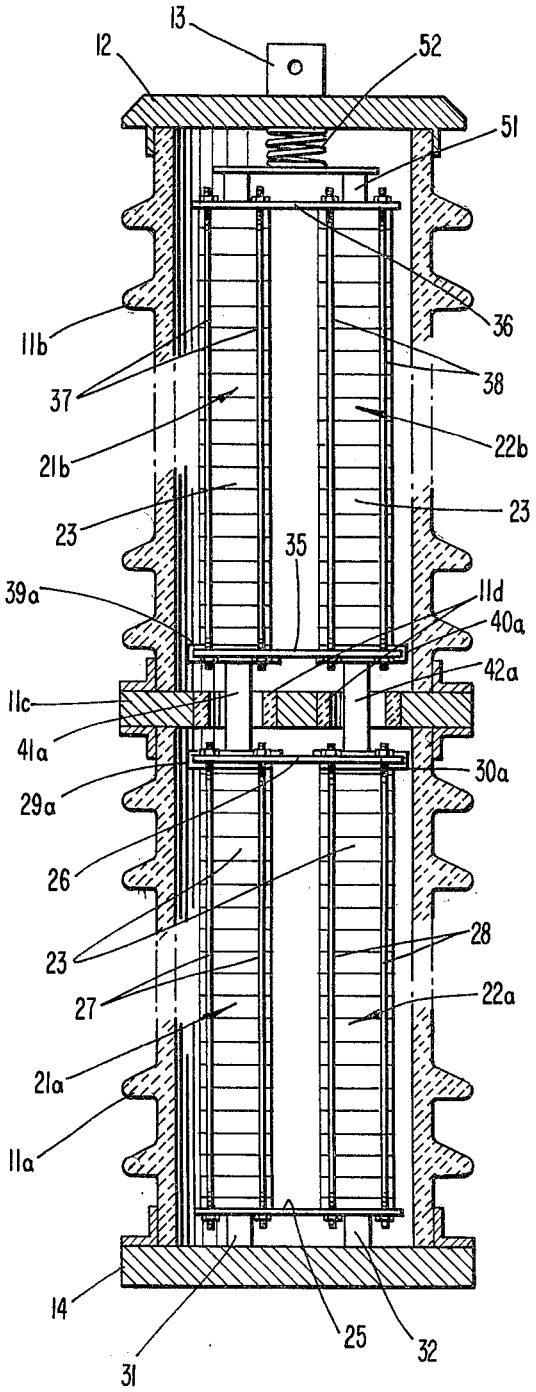

LIGHTNING ARRESTER

BACKGROUND OF THE INVENTION

This invention relates to lightning surge arresters, and more particularly to improvements in the performance, uniformity, cost and strength of such arresters.

Lightning arresters are protective devices used to limit surge voltages in equipment caused by lightning or other disturbances in the equipment circuit. Lightning arresters generally function to bypass or discharge surge current and discharge surge voltages within a fraction of a cycle and prevent damage to the protected equipment.

In very high voltage power transmission lines such as power transmission lines handling 500 KV or more, and long transmission lines or long cable lines having large line capacitance, the energy developed by switching surges is so large that arresters having a large discharge current rating are required. When arresters employing a series gap are used in such transmission lines, i.e., arrestors using non-linear resistors which are isolated from line voltage by spark or arcing gaps in series with the resistors, a series arcing gap having a large discharge current rating is required. Arresters using series arcing gaps having large discharge current ratings have many disadvantages in design, manufacturing, and maintenance.

The recent development of metal oxide, e.g., zinc oxide, resistor elements has resulted in significantly higher nonlinearity and has made possible the elimination of the series gap. In those arresters which do not employ a series gap, a stack of disk-like resistor elements constructed of zinc oxide are used. The diameter of the resistor elements can be increased to correspondingly increase the discharge current rating of the resistor stack, and accordingly the discharge rating of the arrester.

However, large diameter resistor elements have several disadvantages. For example, it is difficult to avoid internal stresses in the large resistor elements during manufacture and it has been found that large diameter resistor elements are subject to cracks. Hence, is it desirable to use smaller diameter resistor elements.

Non-linear resistor stacks in these arrestors can be connected in parallel to further increase the discharge rating of the arrester. In such arresters, it is desirable that the current flowing in the parallel resistor stacks be equal or nearly so for the arrestor to perform at its indicated rating. However, voltage-current characteristics of individual resistor elements are often unequal so that the resulting resistor stacks having the same number of resistor elements tend to have unequal voltage-current characteristics, particularly when a small number of elements are employed.

In many prior art devices, the inequality in voltage-current characteristics is so large as to require that the number of resistor elements forming the individual stacks be varied, i.e., resistor elements must be added to some stacks, to make the voltage-current characteristics of the parallel stacks more nearly equal. Then, means is required to compensate for the difference in length of the parallel resistor stacks. See, for example, Japanese patent disclosure (Kuokaikouhou) No. 27845/74. In general, the prior art does not provide a suitable solution to the problem of unequal voltage-current characteristics in parallel resistor stacks.

SUMMARY OF THE INVENTION

Accordingly, main objects of this invention are to provide a lightning arrester comprising a plurality of resistor stacks connected in parallel, wherein the resistor stacks include an equal number of resistor elements and are of equal length, and wherein the voltage-current characteristics of the parallel stacks are sufficiently close to equality for proper performance of the arrestor.

Other main objects of this invention are to provide an improved construction of the above character which can be used to provide lightning arrestors having a wide variety of current ratings, which is sturdy in construction, and which is relatively inexpensive to manufacture.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the lightning arrestor of this invention comprises a housing; a plurality of elongated electrical resistor stacks disposed in side-by-side relation in the housing and electrically connected in parallel; each of the stacks including a plurality of substacks formed by stacked, non-linear resistor elements of uniform size, the sub-stacks of each stack being aligned end-to-end; means electrically connecting adjacent sub-stacks in each stack; the sub-stacks of each stack having the same number of resistor elements as the adjacent sub-stack of a parallel stack; and means mechanically connecting but electrically insulating adjacent sub-stacks of parallel stacks.

BRIEF DESCRIPTION OF THE DRAWINGS

FIG. 3 is a schematic cross-sectional view of one embodiment of an arrester according to this invention;

FIG. 4 is a schematic cross-sectional view of another embodiment of an arrester according to this invention.

DETAILED DESCRIPTION OF THE PREFERRED EMBODIMENTS

Figure 1:
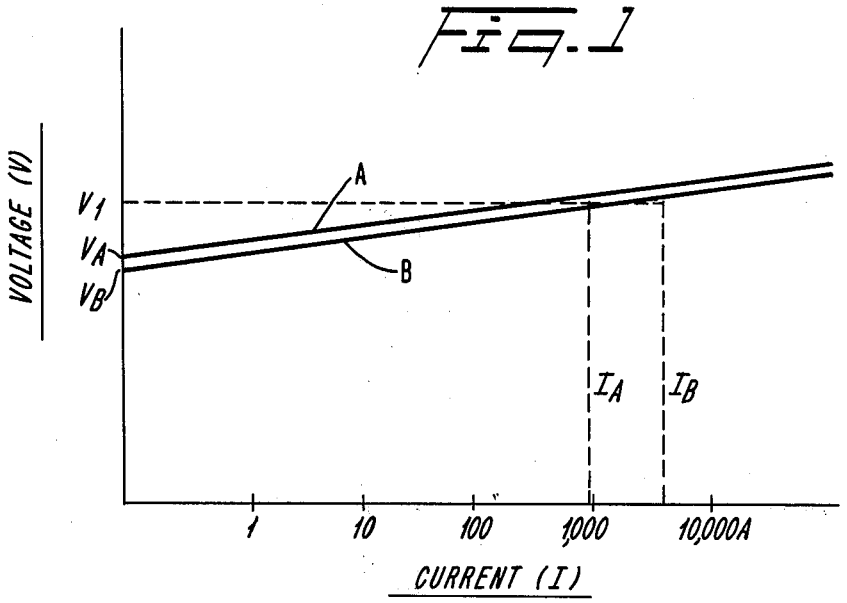
FIG. 1 is a graph which plots voltage versus current for a typical non-linear resistor.

Referring now to FIG. 1, shown therein are the voltage-current characteristics of two uniform size, non-linear resistor elements or disks A and B, each constructed, for example, of zinc oxide. The resistor disks A and B have unequal voltage-current flow currents $I_A$ and $I_B$, respectively, at voltage $V_1$ applied thereto. Current flowing through the resistor disks A and B are minimal below voltages $V_A$ and $V_B$, respectively, as a result of good non-linear characteristics of zinc oxide.

FIG. 1 shows that the resistivity of the resistor disk B is smaller than that of the resistor disk A. Accordingly, the current through the resistor disk B is larger than that through the resistor disk A when these resistor disks A and B are connected in parallel. The resistor disk B will break down first as voltage applied to the parallel connection increases. A lightning arrestor utilizing resistors A and B connected in parallel would have unequal voltage-current characteristics and would be unacceptable.

As easily understood, the situation is similar when stacks of resistor disks are connected in parallel. Inequality in current flowing through the parallel stacks reduces the efficiency of the arrestor and renders it unacceptable.

Figure 2:
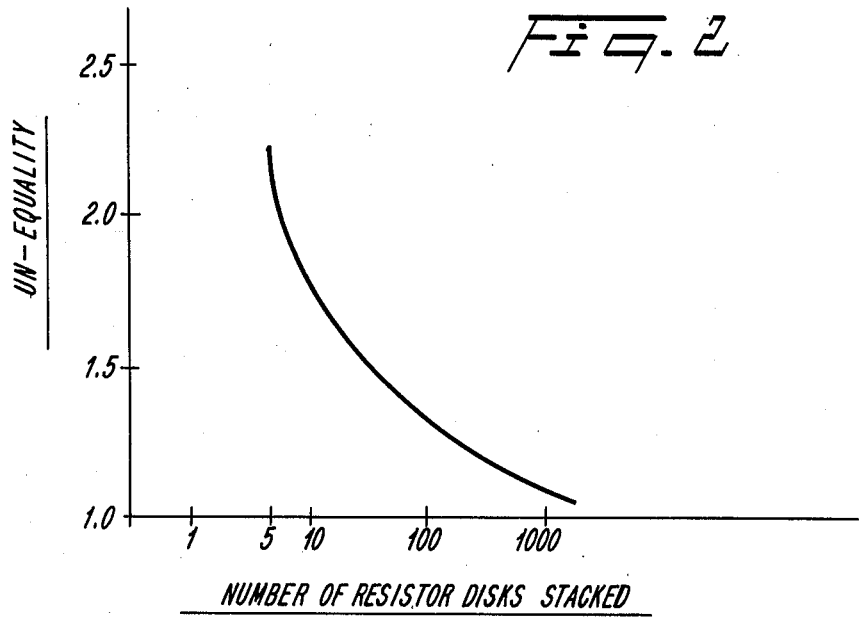
FIG. 2 is a graph which plots inequality of voltage-current characteristics versus the number of non-linear resistor elements in two resistors stacks having the same number of elements.

In accordance with the invention, it has been determined that the inequality of current flowing through parallel stacks of non-linear resistors using the same number of resistor disks decreases as the number of resistor disks in each stack increases. FIG. 2 illustrates how the inequality of current flowing through each of two parallel stacks which use the same number of uniform size non-linear resistor disks, varies with the total number of disks in each stack. In FIG. 2, the number of resistor disks in each stack is plotted along the abscissa, and the ratio of current $I_A$ flowing through one stack A with respect to current $I_B$ flowing through another stack B (i.e., $I_A/I_B$) is plotted along the ordinate. $I_A$ is larger than $I_B$.

The plotted curve of FIG. 2 was made from data derived from testing a large number of resistor stacks and also using standard statistical methods, and is based generally on maximum values of $I_A/I_B$ from various values of $I_A/I_B$. As can be recognized from FIG. 2, inequality of current flowing through stacks A and B becomes smaller as the number of resistor disks contained in the stacks increases.

From this analysis, it has been concluded that each parallel stack of resistors needs at least 35 resistor disks, and preferably 100 or more resistor disks, in order to attain the desirable level of utilization efficiency in a lightning arrestor, i.e., voltage-current characteristics in the parallel stacks which are sufficiently close to equality.

Referring now to FIG. 3, which illustrates one embodiment constructed in accordance with the invention, a generally cylindrical insulation housing 11 which is constructed of an insulating material, for example, porcelain, has a top opening hermetically sealed by a lid 12 of electrically conductive material which has a high tension terminal 13 thereon. A bottom opening in the housing 11 is also hermetically sealed by a base 14 also of conductive material and which is connected to ground by means, not shown. The housing 11 is filled with insulation gas such as, for example, sulfur hexafluoride ($SF_6$).

In accordance with the invention, at least two stacks of non-linear resistor disks having equal numbers of disks are connected in parallel and supported within the housing 11. As embodied herein, a stack of non-linear resistor disks is generally indicated at 21 and comprises two sub-stacks 21*a* and 21*b* aligned end-to-end and electrically connected in series. Another stack of non-linear resistor disks 22 similarly comprises two sub-stacks 22*a* and 22*b* aligned end-to-end and electrically connected in series. The stacks 21 and 22 are electrically connected in parallel, as hereinafter set forth, with connections being made to the lid 12 and the base 14.

In accordance with the invention, each of the sub-stacks are formed by stacked, non-linear resistor elements of uniform size, and the sub-stacks of each stack have the same number of resistor elements as the adjacent sub-stacks of a parallel stack. As embodied herein, the sub-stacks 21*a*, 21*b*, 22*a* and 22*b* are formed by stacked non-linear resistor disks 23 which are constructed of metal oxide, for example, zinc oxide, and each is of the same size and therefore has the same rating. The sub-stacks 21*a* and 22*a* comprises the same number of disks stacked one upon the other, and the sub-stacks 21*b* and 22 comprise the same number of resistor disks stacked one upon the other.

The total number of disks in the series connected sub-stacks21*a* and 21*b* is equal to the total number of disks contained in the sub-stacks 22*a* and 22*b*. It has been determined, as described above, that best results are obtained when the total number of resistor disks in each of stacks 21 and 22 is at least 35, and preferably is 100 or more. This desired number of disks can be attained by selecting individual disks which have a discharge current rating which will attain the total discharge rating for the total number of disks.

In accordance with the invention, means is provided to mechanically connect but electrically insulate adjacent sub-stacks of parallel stacks. As emboided herein, sub-stacks 21*a*, 22*a* are sandwiched between a pair of plates 25 and 26 which are rigidly connected by insulating stud bolts 27 and 28. Plate 16 is constructed of insulating material. Therefore, plate 25 can be constructed of either insulating or conductive material. Preferably, plate 25 is conductive and rests upon conductive supports 31 and 32 which electrically connect the plate 25 to the base 14. This simplifies the electrical connections and provides a more rigid assembly.

The sub-stacks 21*b* and 22*b* are mechanically connected but electrically insulated in a fashion similar to the sub-stacks 21*a* and 21*b*. The resistor disks 23 of sub-stacks 21*b*, 22*b* are arranged in columns between an insulating plate 35 and a conductive plate 36 which are rigidly connected by insulating stud bolts 37 and 38. The sub-stacks 21*b* and 22*b* are mechanically supported on the sub-stacks 21*a* and 22*a* through spacers 41 and 42 which may be either an insulators or conductors. The conducting plate 36 is both electrically and mechanically connected to the lid 12 by a support 51 and a compression spring 52.

In accordance with the invention, means is provided two electrically connect adjacent sub-stacks in each stack. As embodied herein, a generally U-shaped conductor having a base 45 and a pair of legs 29, 39 electrically connects sub-stacks 21*a* and 21*b* of stack 21. Leg 29 is trapped between the top disk 23 of sub-stack 21*a* and insulating plate 26, and leg 39 is trapped between the bottom disk 23 of sub-stack 21*b* and insulating plate 35. Similarly, another generally U-shaped conductor has a leg 30 trapped between the sub-stack 22*a* and conducting plate 26, a leg 40 trapped between sub-stack 22*b* and plate 35, and a base 46 connecting legs 30, 40. It is noted that the U-shaped conductors are insulated from one another by insulation plates 26, 35 so that sub-stacks 21*a* and 22*a*, and sub-stacks 21*b*, 22*b* are electrically insulated even though they are mechanically connected.

In accordance with the invention, the stacks 21 and 22 include the same total number of resistor disks 23 which is at least 35 for each stack, and preferably each of the stacks 21 and 22 include 100 resistor disks or more. As described above for FIG. 2, this ensures that the difference in the discharge capacities between the stacks 21 and 22 is sufficiently small that they can be used together and connected in parallel in the lightning arrestor as shown.

In accordance with the invention, the adjacent sub-stacks of parallel stacks are mechanically connected and form modules of parallel resistor sub-stacks. This is made possible because the parallel sub-stacks have the same number of resistor elements. Substacks 21*a* and 22*a* have the same number of disks 23 as do sub-stacks 21*b* and 22*b*. There is no need to vary the number of disks in the sub-stacks to attain uniform discharge capacity ratings for the stacks 21 and 22 because the large total number of disks in stacks 21 and 22 renders their voltage-current characteristics sufficiently close to being equal. Thus, it is possible to mass produce a relatively small number of different sized sub-stack modules which can be connected in various combinations with other modules to produce a wide variety of arrestors having different ratings.

Furthermore, it will be appreciated that the large number of small sized resistor elements, 35 or 100 or more, arranged in a single stack would require a relatively high compressive force on the elements to maintain the integrity of the stack. Such would also increase the likelihood that the resistor elements would crack or crush causing the stack to fail. By forming the stacks of a plurality of individually assembled sub-stacks, the number of resistor elements in each sub-stack is somewhat smaller, the integrity maintaining force is also somewhat smaller and the likelihood of failure by cracking or crushing the elements is greatly reduced.

Although the pairs of sub-stacks, such as 21*a* and 22*a*, are shown integrally joined by use of single plates 25 and 26, the sub-stack pairs may be constructed individually using separate plates at each end of each sub-stack 21*a*, 22, and then joined together mechanically in the juxtaposed arrangement shown.

Reference is now made to FIG. 4 wherein another embodiment of this invention is illustrated, and wherein corresponding or similar parts are indicated by the same reference numerals as in FIG. 3. In this embodiment, an insulating housing which may be constructed of porcelain is shown as including housing portions 11*a* and 11*b* which enclose sub-stacks 21*a* and 22*a* and 21*b* and 22*b* respectively. A plate 11*c* is interposed between and joins housing portions 11*a* and 11*b*, and conductive plates 14 and 12 close and hermetically seal the outer ends of housing portions 11*a* and 11*b*, respectively. The plate 11*c* has a pair of through holes which, if the plate is conductive, are provided with ring-like insulators 11*d*.

As embodied herein, a pair of generally C-shaped conductors 29*a* and 30*a* span the insulation plate 26 and connect the end disks 23 of sub-stacks 21*a* and 22*a* to conductive spacers 41*a* and 42*a*, respectively. Similarly, a pair of generally C-shaped conductors 39*a* and 40*a* span the insulation plate 35 and connect the end disks of sub-stacks 21*a* and 22*b* to conductive spacers 41*a* and 42*a*, respectively. Conductive spacers 41*a* and 42*a* extend through the ring-like insulators 11*d* and electrically connect sub-stacks 21*a*, 21*b* and 22*a*, 22*b*, respectively.

According to this embodiment of the invention, the insulating housing which encases the sub-stacks is made from two or more parts, i.e., housing portions 11*a* and 11*b*. These housing portions 11*a* and 11*b* can be made in different lengths to accommodate different sub-stack lengths and this contributes even further to the versatility and low manufacturing cost of the resulting arrestor. Thus, instead of constructing the arrestor housing of one piece, as shown in FIG. 3, with the attendant limitation on the overall size of arrestor, individual housing portions 11*a* and 11*b* of the same or different lengths which correspond to the length of the sub-stacks housed therein, can be selected and used together as shown in FIG. 4 to produce arrestors having a wide variety of capacities.

Figure 5:
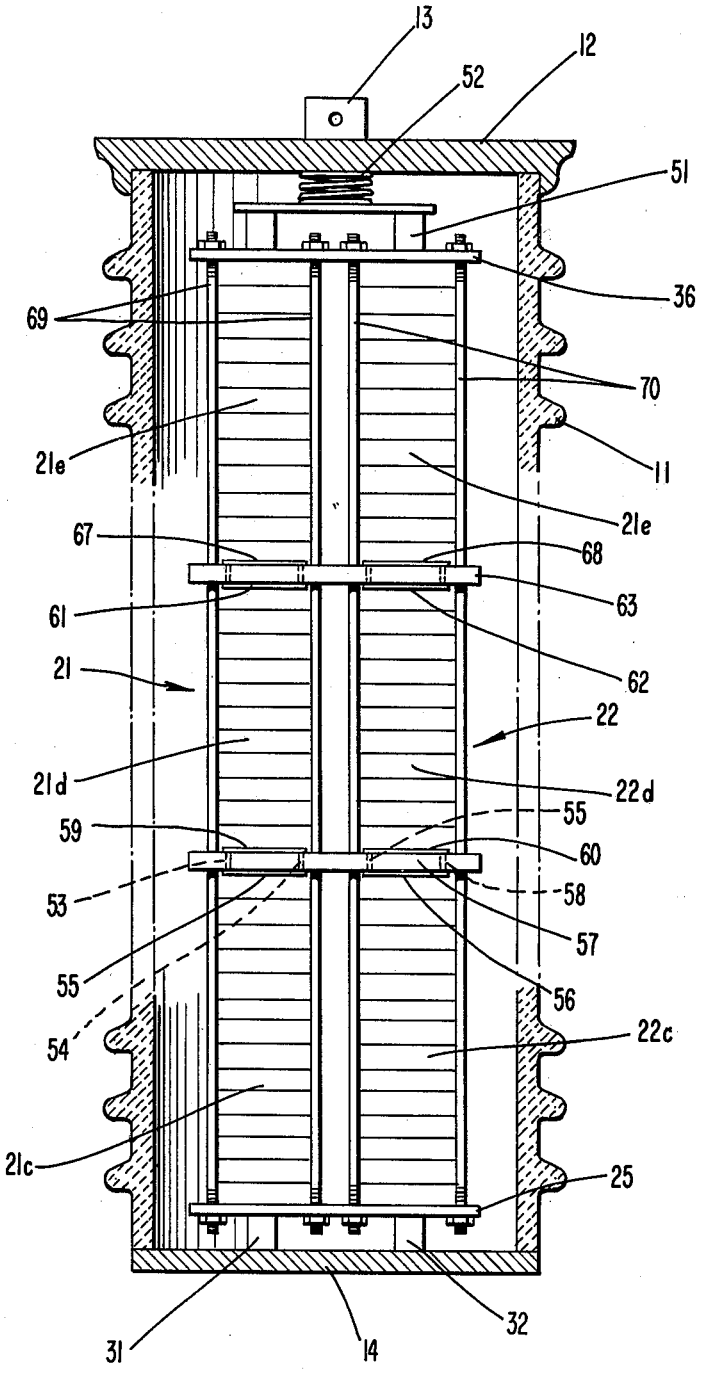
FIG. 5 is a schematic cross-sectional view of still another embodiment of an arrester according to the invention.

Referring now to FIG. 5 showing still another embodiment according to this invention, the stack 21 comprises three substacks 21*c*, 21*d* and 21*e*, and the stack 22 similarly comprises three sub-stacks 22*c*, 22*d* and 22*e*. The number of resistor disks 23 in sub-stacks 21*c*, 21*d*, 21*e* is the same as the number in sub-stacks 22*c*, 22*d*, 22*e*, respectively, and the total number of disks in stacks 21 and 22 are equal. Employment of three or even more sub-stacks is preferable when the number of resistor disks in each stack becomes large because it helps to mechanically strengthen the stack structure and prevents mechanical failure as described above.

As embodied herein, the sub-stacks 21*c* and 22*c* are supported on the conductive plate 25 which, in turn is supported on the base 14 through conductive supports 31 and 32. An insulating plate 57 is positioned between sub-stacks 21*c*, 22*c* and sub-stacks 21*d*, 22*d*. Electrical connection between sub-stack 21*c* and sub-stack 21*d* is made by a conductive plate 55 sandwiched between the top disk 23 of sub-stack 21*c* and plate 57, and a conductive plate 59 between the bottom disk 23 of sub-stack 21*d* and plate 57. Conductor plates 55, 59 are electrically connected by conductors 53, 54 which pass through insulating plate 57. Similarly, sub-stacks 22*c*, 22*d* are electrically connected by conductor plates 56, 60 and conductors 55, 58.

In like manner, sub-stacks 21*d*, 22*d* are electrically connected to sub-stacks 21*e*, 22*e* by conductor plates 61, 67 and 62, 68, respectively, and by conductors which extend through insulating plate 63 and connect respective pairs of the plates. A conductor plate 36 is positioned atop the sub-stacks 21*e*, 22*e* and the entire stack assembly is held together by insulating stud bolts 69, 70 which pass through conductor plates 25, 36. As was the case in the previous embodiments of FIGS. 3 and 4, support 51 and compression spring 52 mechanically and electrically connect the conductor plate 36 to the lid 12 which has a high tension terminal 13 thereon.

It will be appreciated that in accordance with the invention, more than three sub-stacks can be provided in each stack particularly when a very large number of resistor disks are employed. This facilitates high mechanical strength in the construction despite its long axial length and large number of resistor disks. Also, three or more stacks each including a plurality of sub-stacks, can be connected in parallel with adjacent sub-stacks or parallel stacks mechanically connected to but electrically insulated from one another.

Although preferred embodiments of this invention have been illustrated and described above in detail, various additions, substitutions, modifications, and omissions may be made thereto without departing from the spirit of this invention.

What is claimed is:

1. A lightning arrestor comprising:

a housing;

a plurality of elongated electrical resistor stacks disposed in side-by-side relation in said housing and electrically connected in parallel;

each of said stacks including a plurality of sub-stacks formed by stacked, non-linear resistor elements of uniform size, said sub-stacks of each stack being aligned end-to-end;

means electrically connecting adjacent sub-stacks in each stack;

the sub-stacks of each stack having the same number of resistor elements as the adjacent sub-stack of a parallel stack;

and means mechanically connecting but electrically insulating adjacent sub-stacks of parallel stacks.

2. A lightning arrestor according to claim 1, the adjacent sub-stacks of parellel stacks being connected by plates which sandwich the resistor elements of said sub-stacks, at least one of said plates being constructed of insulating material, and insulating bolts connecting said plates.

3. A lightning arrestor according to claim 2, the adjacent sub-stacks in each stack being electrically connected by conductors having portions trapped between the adjacent ends of said sub-stacks and the adjacent plate, said conductor portions connected to each other.

4. A lightning arrestor according to claim 1, said resistor stacks each including at least 35 resistor elements.

5. A lightning arrestor according to claim 1, said resistor stacks each including at least 100 resistor elements.

6. A lightning arrestor according to claim 2, the adjacent sub-stacks in each stack being electrically connected by conducting spacers which extend through openings in the plates at adjacent ends of adjacent sub-stacks.

7. A lightning arrestor according to claim 1, said housing including a plurality of portions each surrounding a respective set of sub-stacks of parallel stacks, and means for connecting adjacent housing portions.

8. A lightning arrestor according to claim 1, said housing being hermetically sealed and filled with an insulating gas.

9. A lightning arrestor according to claim 1, said resistor elements comprising disks constructed of zinc oxide.

* * * * *